US007506467B2

(12) United States Patent
Maldonado Ferreira Lopes

(10) Patent No.: US 7,506,467 B2
(45) Date of Patent: Mar. 24, 2009

(54) CHILDPROOF AND ACCIDENT-PROOF ROTATING PERCUSSION HANDGUN

(76) Inventor: Fernando Jorge Maldonado Ferreira Lopes, Rua das Cerejeiras Lote 47/48, Foros de Arnora, P-2840 Seixal (PT)

( * ) Notice: Subject to any disclaimer, the term of this patent is extended or adjusted under 35 U.S.C. 154(b) by 0 days.

(21) Appl. No.: 10/596,049

(22) PCT Filed: Nov. 26, 2004

(86) PCT No.: PCT/PT2004/000028

§ 371 (c)(1),
(2), (4) Date: Mar. 7, 2007

(87) PCT Pub. No.: WO2005/052492

PCT Pub. Date: Jun. 9, 2005

(65) Prior Publication Data

US 2007/0240351 A1 Oct. 18, 2007

(30) Foreign Application Priority Data

Nov. 26, 2003 (PT) ..... 103048

(51) Int. Cl.
*F41C 9/00* (2006.01)
*F41A 3/00* (2006.01)

(52) U.S. Cl. ..... 42/1.16; 42/52; 42/41; 42/46

(58) Field of Classification Search ..... 42/1.08–1.16, 42/46, 52, 53, 114, 40, 41, 44
See application file for complete search history.

(56) References Cited

U.S. PATENT DOCUMENTS 363,043 A * 5/1887 Bovy ..... 42/40
1,534,085 A * 4/1925 Schwaerzer ..... 89/1.1
1,897,992 A * 2/1933 Ailes ..... 42/2
2,195,711 A * 4/1940 Hutchison et al. ..... 42/1.08
2,444,920 A * 7/1948 Davis, Jr. et al. ..... 89/27.11
2,625,764 A * 1/1953 O'Brien et al. ..... 42/146
3,545,116 A * 12/1970 Babington ..... 42/1.08
3,786,716 A * 1/1974 Wilson ..... 89/1.812
3,956,843 A * 5/1976 Litman ..... 42/105
5,469,649 A * 11/1995 Rowlands et al. ..... 42/43
5,483,362 A * 1/1996 Tai et al. ..... 359/1
6,397,505 B1 * 6/2002 Stratton et al. ..... 42/47

* cited by examiner

*Primary Examiner*—Stephen M Johnson
*Assistant Examiner*—Daniel J. Troy
(74) *Attorney, Agent, or Firm*—Brooks Kushman P.C.

(57) ABSTRACT

The present invention relates to a small-calibre defence system, characterised by the use of an unconventional process, with the following main characteristics: the absence of a trigger and hammer, which are replaced by firing mechanisms in the form of a handle (B) inside which the percussion system (C) is activated by rotating it in relation to the barrels (E), thus forcing the striker to move up a ramp thereby compressing the tensor system, after which it is released and the firearm is detonated, this merely being an example of what the invention covers; the novelty of its design, which has been devised in order to make it difficult or impossible for a child to activate it; it is assembled longitudinally in multiple barrels (E), with a manually tightened rotating safety lock (D), contrary to the buttons and catches of similar firearms; it has a integrated Progressive Impact Area Indicator laser sight (F) which functions progressively according to distance; and it has a fold-away grip (G).

11 Claims, 11 Drawing Sheets

G

CHILDPROOF AND ACCIDENT-PROOF ROTATING PERCUSSION HANDGUN

SCOPE OF THE INVENTION

The present invention relates to a firearm with various defence and safety mechanisms, which combines a high level of defence and effective protection by virtue of its unique characteristics with the advantage of providing greater safety, in order to go some way towards reducing the high firearms accident rate among adults and children.

PRIOR ART

Some safety devices which can be adapted to various models of firearms are already known, as well as certain firearms that are built with a particular basic safety system in order to prevent them from being used incorrectly or inadvertently, thereby causing an accident.

Some safety devices satisfactorily fulfill their function, but they have certain inconveniences, namely the fact that once they are installed the firearm becomes useless as a means of defence, unless the key remains with it, which totally defeats the intended purpose. Firearms, which are designed to incorporate an additional safety system, for example a button, lever, catch or even the removal of the magazine in order to prevent accidental firing, have proven to be very ineffective as a means of preventing accidents.

SUMMARY OF THE INVENTION

The present invention does not propose to remove the risk of accidents caused by firearms, because this would be an impossible task, but rather to help substantially reduce the risk of accident, in order to reverse the growing trend of the increasingly high numbers of accidents recorded. For this purpose, a non-lethal personal defence system is presented, which has aggressive lines and design and at the same time is aesthetically pleasing, hardwearing, childproof and accident-proof.

This new firearm gives rise to a new classification in light weapons, the Rotating Percussion Handguns, to which this patent refers. It presents a whole range of attributes and characteristics, in particular the absence of a trigger (the most sensitive element common to all light weapons). The simple and obvious way in which a trigger is fired makes it the main factor responsible for the high rate of accidents among children and adults, as it can be inadvertently activated by anyone's hand, or rather finger, causing any conventional light calibre weapon to fire.

Rotating Percussion Handguns increase by more than twofold the level of effective protection against accidents by virtue of the fact that the trigger found in any light weapon is removed. In fact, it is not possible to activate this type of firearm using only one finger and it cannot even be fired with only one hand.

In the present invention, its original and unconventional method of firing means that in principle it will be difficult for someone who is not familiar with the system to use it. It is activated by rotating the handle and consequently the internal percussion mechanism in relation to the main static body, which requires the use of two hands, one to rotate the handle in relation to the set of barrels and the other to hold the barrels in place in order to prevent them from rotating with the handle. This means that it is impossible to operate the firearm with only one hand, which contributes substantially to preventing accidents.

Another feature of the safety system is that the nominal diameter of the handle that activates the firing mechanism is slightly enlarged, so that the normal-sized hand of a four or five-year old child would not be able to grip the diameter of the handle and operate the firing mechanism, thereby causing an accident. At the same time, the strength that is required to activate the percussion system can be adjusted and calculated so that a small child would not be able activate it.

The mechanical safety device that locks the firearm and prevents it from being fired is in itself another fundamental feature of the present invention. In all similar low-calibre weapons the "on/off" safety systems use catch, lever or button mechanisms which, when they are unlocked, leave the firing mechanism cocked and ready to fire as soon as the trigger is touched with a single movement, thus making it extremely easy for the gun to be fired accidentally.

In the case of the present invention, in spite of its simplicity, a system is designed wherein it is necessary to rotate the safety wheel several times around the locking pin in order to move it vertically upwards or downwards, this being the only way of unlocking or locking the firing mechanism. Thus, various rotating movements of the safety wheel are required in order for the firing mechanism to be activated and not simply a single movement, as is normally the case with light weapons. The system can also be locked by manually tightening it, which prevents a child from unlocking it.

Another characteristic of the firearm of the present invention is that it does not have the unstable hammer (though this in itself is not a novel feature), which also causes so many accidents when firearms are banged against an obstacle accidentally or during play or are carelessly dropped, thus causing them to detonate.

We have opted for a cartridge as the ideal ammunition for this purpose, in order to provide the user with a greater level of protection, since a weapon that fires a large number of projectiles covering a certain area is more efficient than one that fires a single projectile at the same area. This feature, which is intrinsic to the use of a cartridge as the chosen ammunition, will increase the likelihood of the target being hit by at least some of the projectiles even if the weapon is fired from a greater distance. The ammunition chosen is also the lowest calibre cartridge available on the market, since it has a very low kinetic energy load due to the small size of the lead projectiles and the fact that the propelling load is low, which will safeguard the physical integrity of a possible assailant, by wounding but not killing, unless the gun is fired at point-blank range and a vital organ is hit. This will avoid complicated legal problems and remorse felt for taking someone's life, even if it were a case of legitimate self-defence.

Another important feature is that this gun can be fired inside a pressurised aircraft in transit in any atmospheric plane, as its projectile load does not have enough kinetic energy to break a window or even to penetrate the considerable thickness of the various different layers of fuselage material and therefore depressurise the interior, meaning that this firearm can be used as an excellent weapon of defence in the fight against air terrorism in commercial aircraft in the cockpit and control cabin, which are areas that are restricted to the crew.

However, in other cases, it can also be adapted by making the necessary alterations, in order to fire ammunition of any type and calibre.

The new type of laser sight used in this handgun, is also object of this patent, and was projected to be used with weapons that fire shot shell type ammunition, and is designated as Progressive Impact Area Indicator—P.I.A.I., it makes possible to accurately choose the area of the target to be hit, by enlarging or reducing the area of dispersion indicator, proportionally to the distance to the target, giving the user a precise notion of the aiming area, therefore avoiding unnecessary errors while at the same time the laser area indicator functions as a persuasive warning element.

Another important feature of the present invention is the simple design of the parts and mechanisms which constitute the Rotating Percussion Handgun, thus making it a reliable and relatively economical weapon with low production costs and minimum maintenance, consisting of a fairly small set of parts that are easy to produce on an industrial scale.

The various parts mentioned in this description and the drawings can be used individually or together in any combination with other elements having different characteristics and uses. It may therefore be understood that this invention is not restricted to the elements and characteristics described and illustrated herein and that other variations can be included in the spirit of the invention. This applies to the firing mechanism incorporated into the handle, the ejection mechanism, the rotating safety locking and tightening system, the laser sight which functions accordingly to distance, the R.D.W.S. middle weapon bayonet system, the detachable handle, the variable number of barrels and the possibility of detaching them.

USE AND PERFORMANCE

Childproof and accident-proof non-lethal, short-range, small-calibre household defence system, designed to provide users with greater effective protection, while at the same time offering a high level of safety when the firearm is handled, thus giving it four intended uses:

- as a firearm able to fire four consecutive cartridges, comprising eight rounds of ammunition, four in the chambers and four more in a special container inside the handle;
- as a self-defence baton in possible body combat, by virtue of its ergonomic format as well as its actual weight;
- as an optional extra means of defence, characterised by the use of a secondary defence system during the critical period of time when the ammunition runs out and the firearm is open and is being reloaded, this system being known as the "Reload Defence Weapon System" (R.D.W.S.), in the form of a middle weapon bayonet type built into and supported by the firing handle;
- by folding the handle in relation to the barrels on its hinge and opening it to a certain angle, will separate the firearm into two parts, i.e. the set of barrels which can be used as a smaller baton or throwing weapon and the handle with a built-in bayonet constituting a dagger, which serves as a very useful last resort weapon, in the event of a possible direct confrontation with one or more attackers.

BRIEF DESCRIPTION OF THE DRAWINGS

The invention is described and explained hereunder with reference to the attached drawings, which represent a non-restricted embodiment. In the drawings.

DETAILED DESCRIPTION OF THE INVENTION

Figure 1:
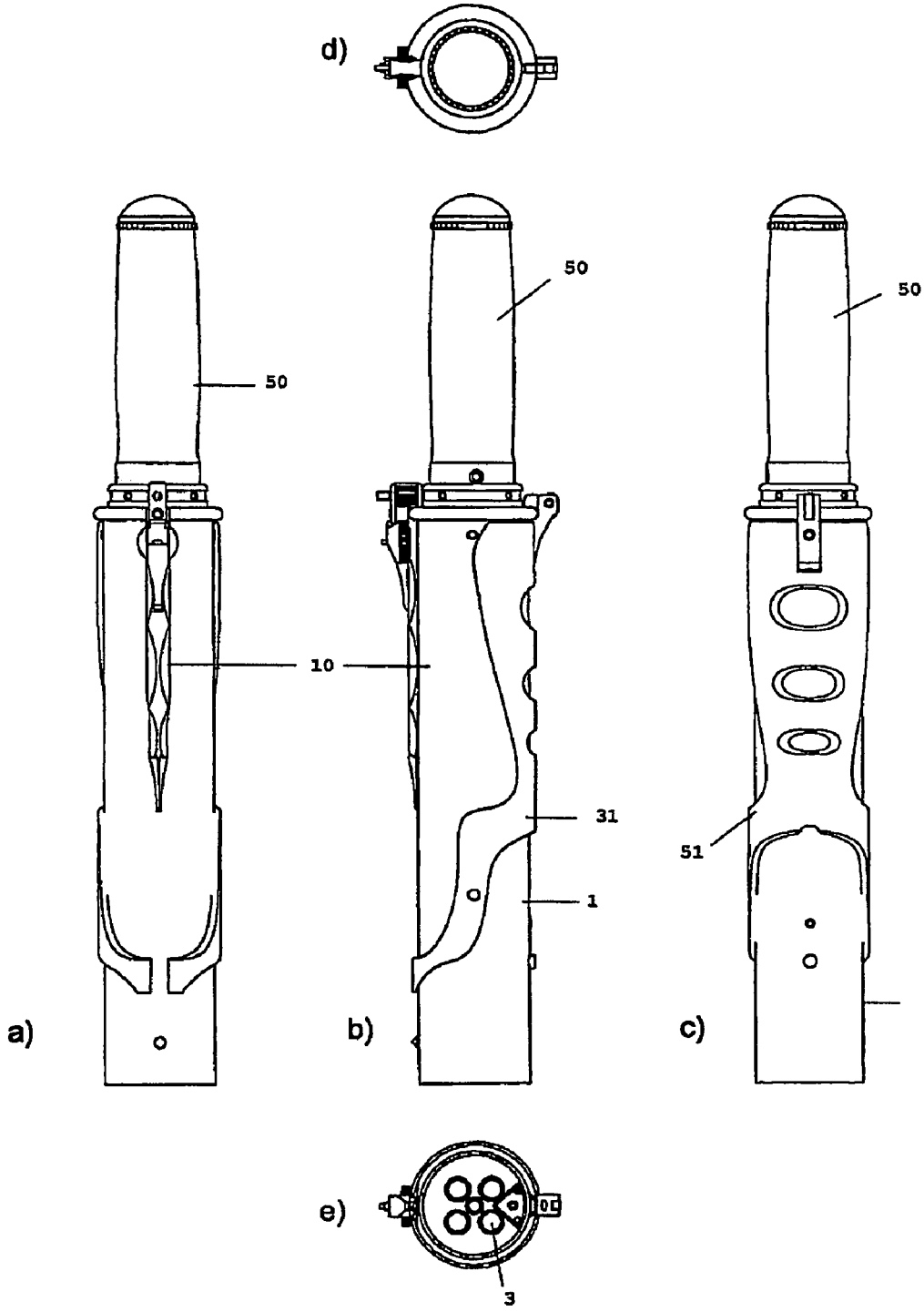
FIG. 1 shows general views representing the whole of the firearm, with the grip closed, depicting a plan view (a), a side view (b), a view from below (c), a rear view (d) and a front view (e).
Figure 2:
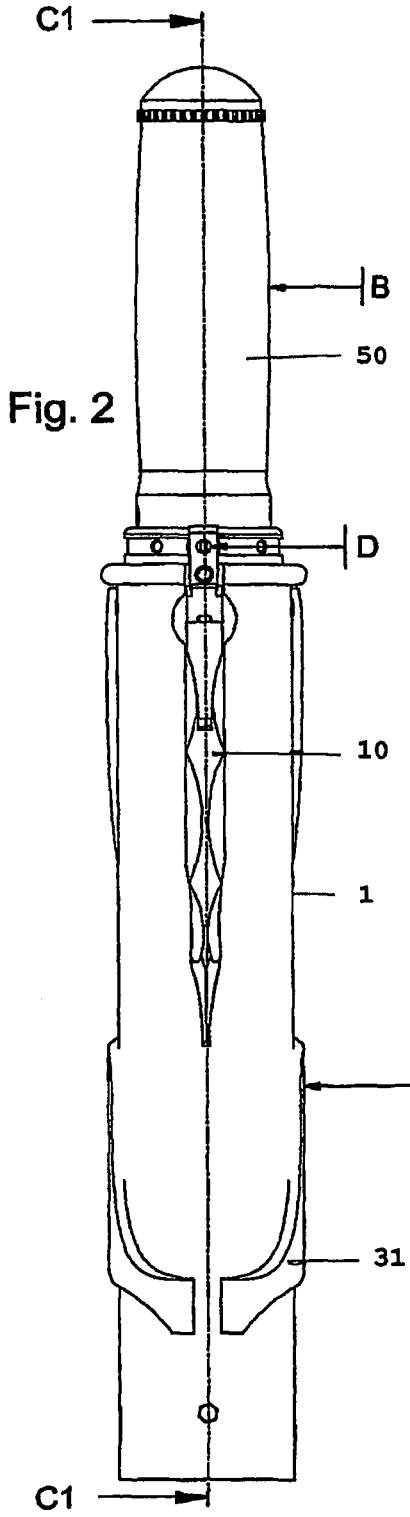
FIG. 2 shows a view from above representing the axis of the longitudinal cross-section C1-C1 with the grip closed.
Figure 3:
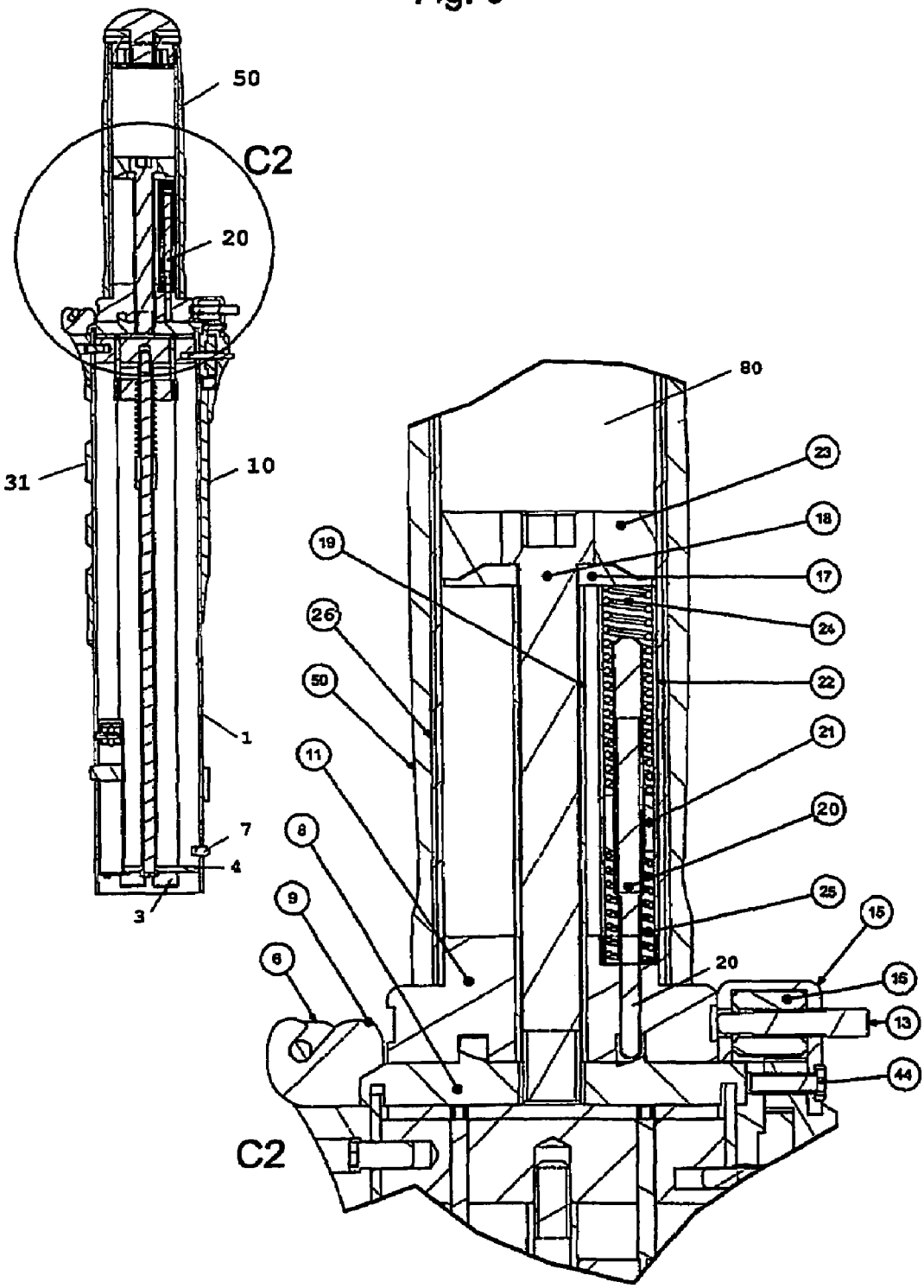
FIG. 3 shows an aerial view of the detailed view C2, which represents the percussion and firing mechanism with the most important parts duly indicated and numbered.
Figure 8:
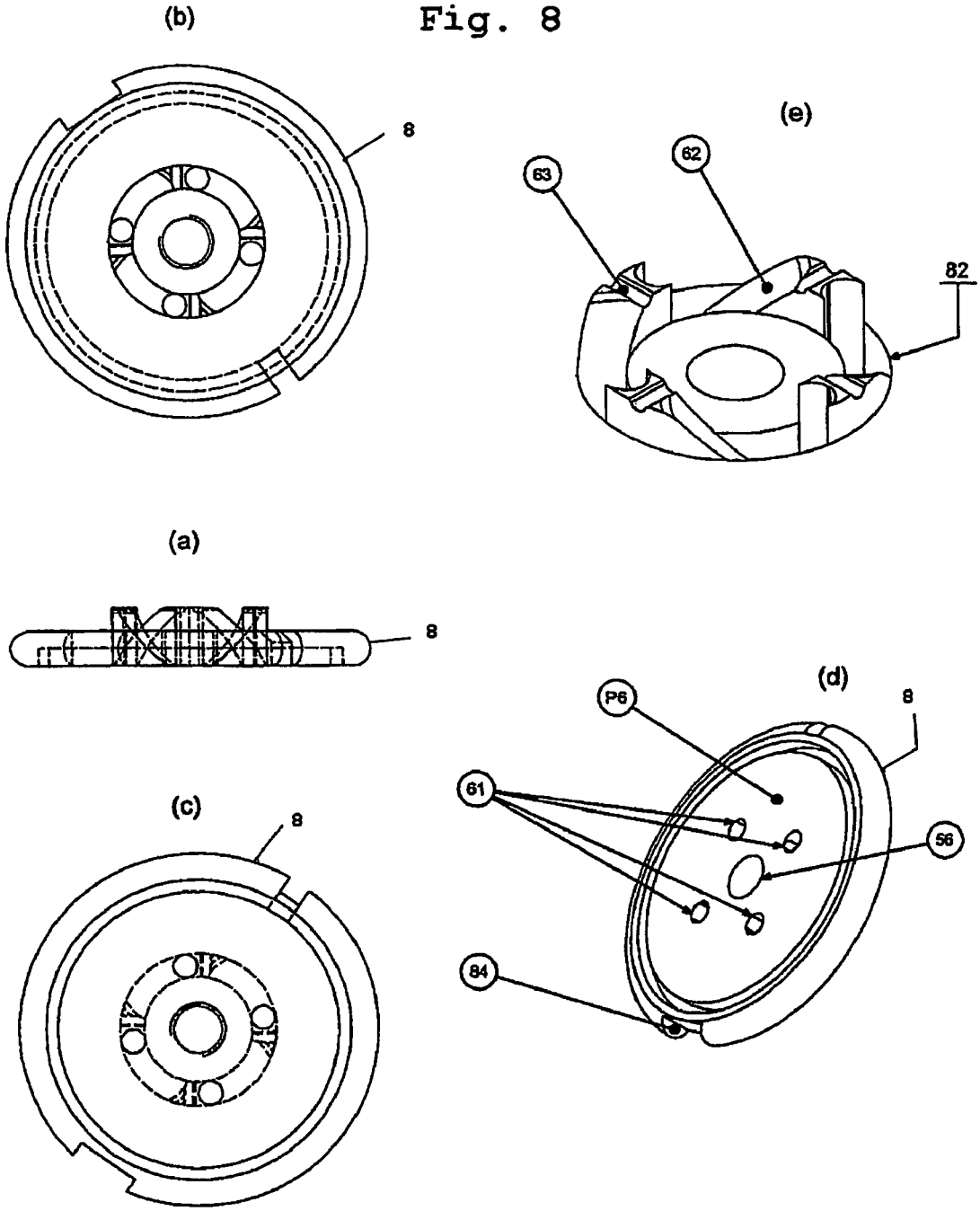
FIG. 8 shows various views representing the part (8)—ramps disc—depicted in elevation (a), in plan view (b), in a view from below (c), and in an auxiliary perspective view (d), and it also shows an auxiliary view of the set of guiding ramps 82, pre-firing points (63) and firing or resting points (61).

As can be seen from the Figures, the firearm is generically represented in FIGS. 1 and 2. FIG. 3, which illustrates the mechanical percussion and firing system (c) situated inside the rotating handle (B), shows in the resting position the striker (20) inserted by its ends and balanced between the return spring (25) and the compression spring (24) by means of the kinetically-supported cylindrical threaded adjustment block (21) for adjusting the impact force of the striker (20), which at the same time adjusts the position of the striker in relation to the plane (P6) of the disc with projections (8) (FIG. 8*d*).

Figure 9:
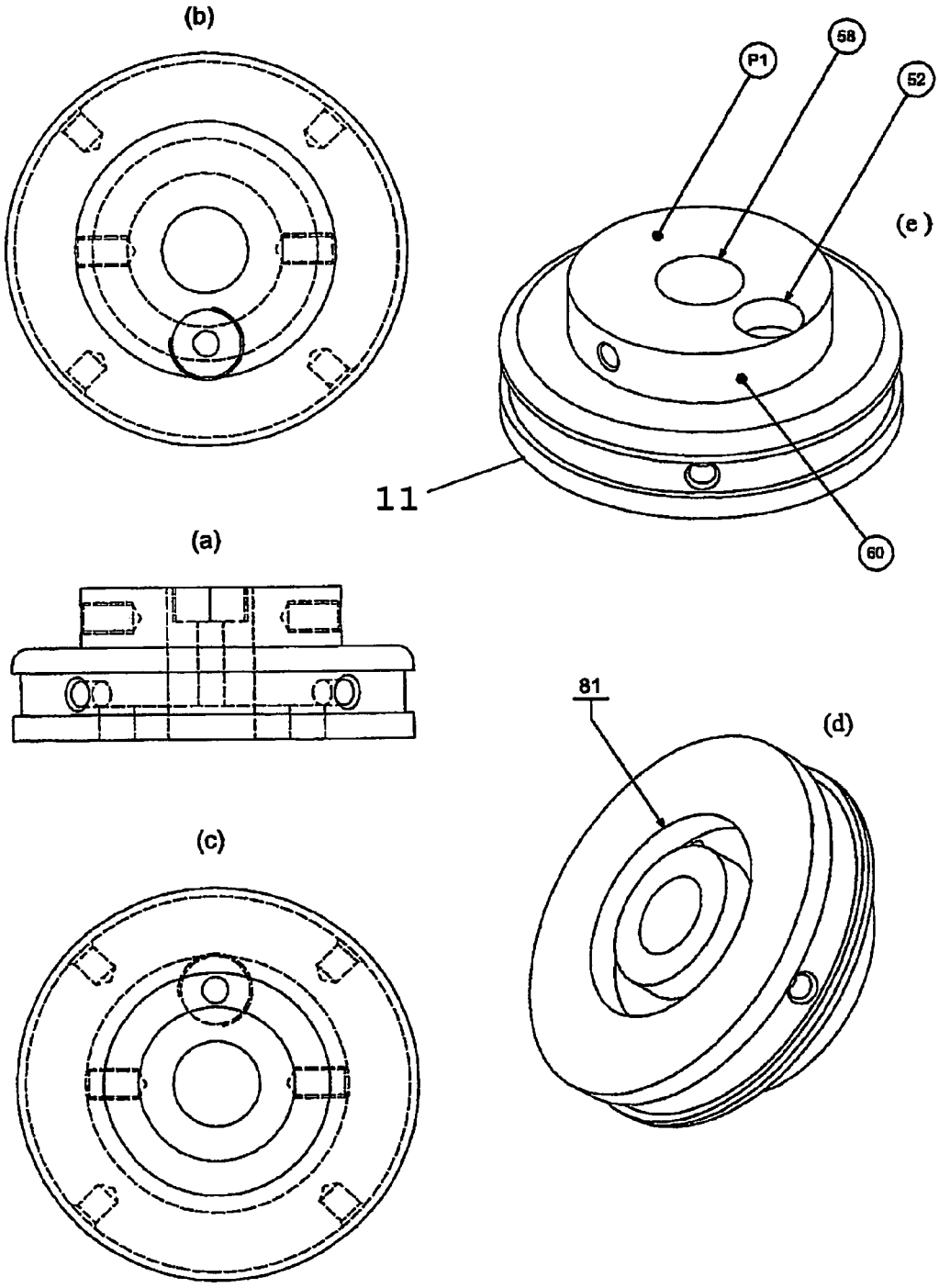
FIG. 9 shows various views representing the part (11)—striker guiding disc—depicted in elevation (a), in plan view (b), in a view from below (c), and in auxiliary perspective views from above (d) and from below (e).

The ramps disc (8) displays a set of guiding ramps (82) (FIG. 8*e*) which, when the whole constituted by the firing handle (FIG. 5) rotates, rest(s) inside the annular recess (81) (FIG. 9*e*).

The return spring (25) is supported at one end inside a housing (52) in the plane (P1) (FIG. 9*e*) of the guiding disc (11) of the striker (FIG. 9*d*), with the other end resting on the plane (P3) (FIG. 5) of the adjustment unit (21). The compression spring (24) rests on the plane (P4) of the adjustment unit (21), and is compressed in relation to the plane (P5) of the percussion assembly support ring (17) which supports the percussion assembly. The ring (17) functions as a housing for the rubber block (23) which damps the kinetic energy of the recoil resulting from the detonating gases, which is attached to the head of the screw (18) under a certain amount of pressure, being limited on the outside of its diameter by the inside of the resistant tube (26) of the handle.

The firing set (C) consists of the striker (20), adjustment block (21), return spring (25), compression spring (24), and it is surrounded by the transporting tube (22), which in turn is attached by means of an external thread to the threaded housing (52) (FIG. 9*e*) in the striker guiding disc (11), which tube must have along its length a minimum clearance between the end (54) of the tube (22) and the plane (P5) of the percussion assembly support ring (17), in order to allow movement with a minimum amount of friction between the various parts that make up the mechanism.

The screw (18) acts as a central axis of the firing mechanism, around which the set comprising the striker (20), the support and adjustment block (21), the return spring (25), the compression spring (24), the transporting tube (22) and the striker guiding disc (11), rotates according to a translatory movement restricted by the planes of the ramps disc (8) and of the percussion assembly support ring (17), both of which are static.

The screw (18) also has its end (55) threaded inside the central threaded hole (56) (FIG. 8*d*) of the ramps disc (8), being surrounded by the supporting tube (19) the purpose of which is to solidly attach the percussion assembly support ring (17), being the end of the tube (19) resting against the plane (P6) (FIG. 8*d*) of the disc with projections (8), tightly and freely passing through the cylindrical hole (58) (FIG. 9*e*) of the striker guiding disc (11).

The whole set of parts described above is inserted longitudinally inside the housing tube (26), the end (59) of which is solidly attached to the circular surface (60) of the striker guiding disc (11) by means of an appropriate screw or thread, the outer handle (50) being attached thereto by means of two screws (51), which are concentric and diametrically opposite, thus allowing the whole percussion assembly to rotate and thus cause the firing of a shot.

This rotating movement will release from its resting position the internal mechanism of the handle, which, when rotating movement is transmitted to it around its longitudinal axis, will force the firing set (FIG. 5) consisting of the striker (20), adjustment block (21), return spring (25) and compression spring (24) inserted inside the transporting tube (22), coupled to the striker guiding disc (11) situated at a certain distance from the central axis (52), to execute a translatory movement around the longitudinal axis of the handle.

In this way, the striker (20) is forced, from its resting point (61) (FIG. 8*d*), to commence a firing cycle, starting by sliding along one of the various guiding ramps (62) which will transmit through the compression spring (24)—resting on the percussion assembly support ring (17) fixed to the head of the central screw (18) at a distance corresponding to the length of the tube (19) which houses the screw that supports the whole firing system—sufficient kinetic energy to the body of the striker (20), so that when the pre-firing point (63) is reached and the striker is released from the tension exerted in the compression spring (24), it will move forward with enough force to detonate the shell.

The firing cycle is completed when the striker returns to the resting point (61) coinciding with the starting point for another cycle.

Figure 6A:
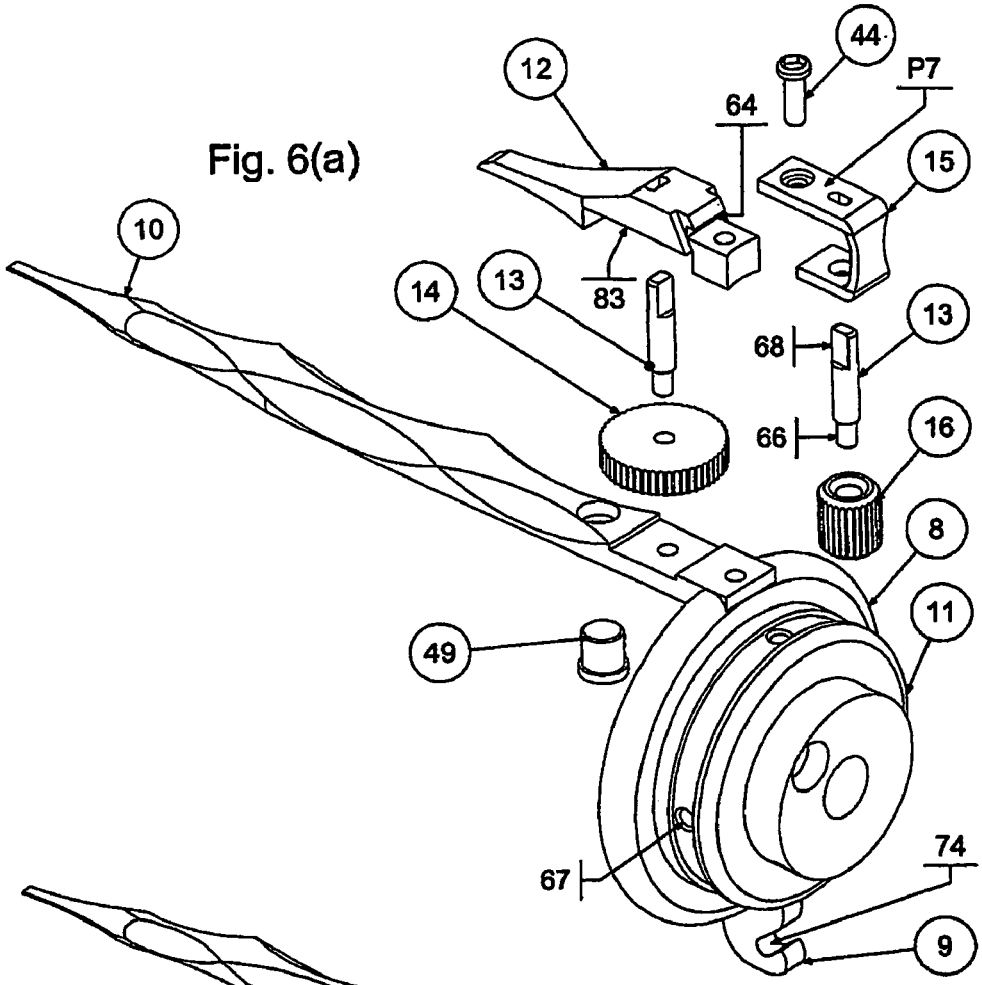
FIG. 6 shows isometric perspective views representing the safety locking system, in both the assembled 6(*b*) and exploded 6(*a*) versions, with the various elements numbered and individually arranged and also showing the optional bayonet system.
Figure 6B:
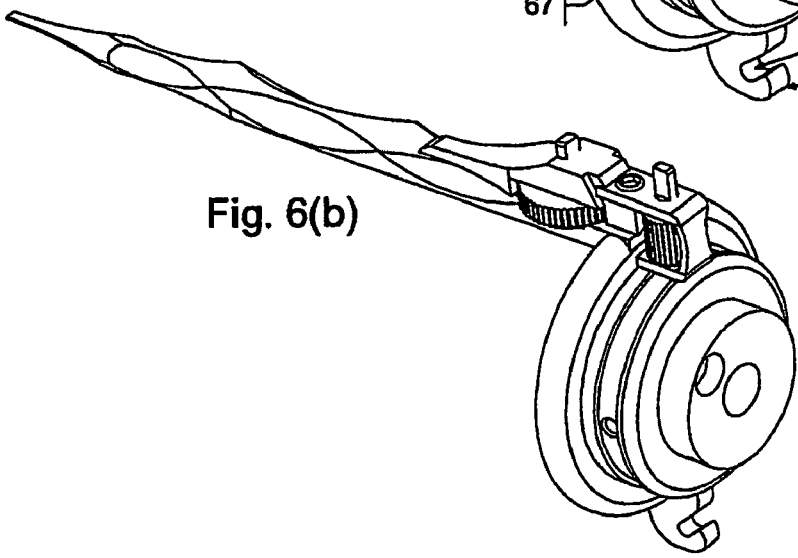

The rotating safety locking and tightening system (FIG. 6) is a mechanism designed to prevent the rotating movement of the rotating firing handle around its own axis, consequently activating the percussion system. Various rotating movements of the safety wheel (16) are required in order to lock or unlock the active safety system (D) using the force exerted by the tightening of the safety wheel (16). This wheel has a central threaded hole through which the rotationally static threaded safety pin (13) passes, limited to movement according to its vertical axis, moving up or down as the wheel (16), limited by its top and bottom planes, is manually rotated around its axis in one direction or in the opposite direction.

The wheel (16) and the pin (13) are both housed inside the part (15) that supports the system (FIG. 6*a*), which is attached by means of a screw (44) and an indentation (64) in the safety locking assembly (12), and at the same time is the vertical guide of the safety pin (13).

When rotating movement is transmitted to the system, the pin (13) totally recoils to the level of the top plane (P7) (FIG. 6*a*) of its guiding part (15), corresponding to the activated safety position. The other end (66) locks the mechanism of the rotating firing handle when it is inserted inside one of four holes (67) (FIG. 6) in the striker guiding disc (11) equal in number to the number of barrels.

When the safety wheel (16) is rotated in the opposite direction, the pin (13) rises, unlocking the locking system and releasing the rotating firing handle, while at the same time the top end (68) of the pin becomes visible in the form of a projection in relation to the top plane of the guiding part (15).

The opening and closing (FIG. 6) of the firearm is achieved by means of a similar system, using the closing wheel (14) assembled inside the safety locking assembly (12), said wheel being restricted in its top and bottom planes and only having the rotating movement allowed by the safety pin (13) and by the wheel slot (83) of the part (12).

Figure 2A:
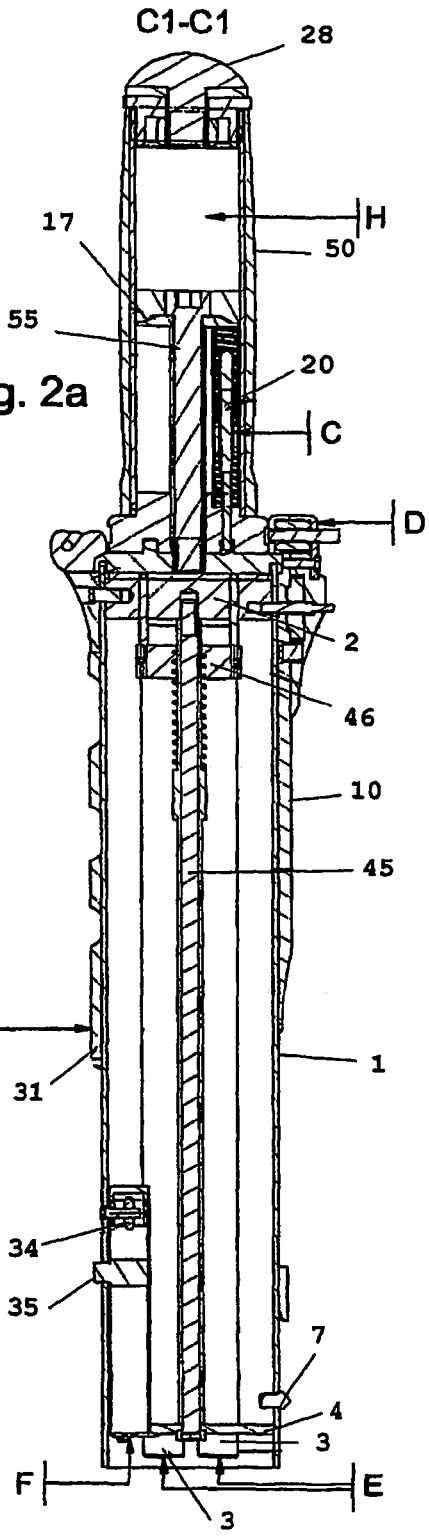
FIG. 2*a* represents the longitudinal central cross-section of FIG. 2.
Figure 4:
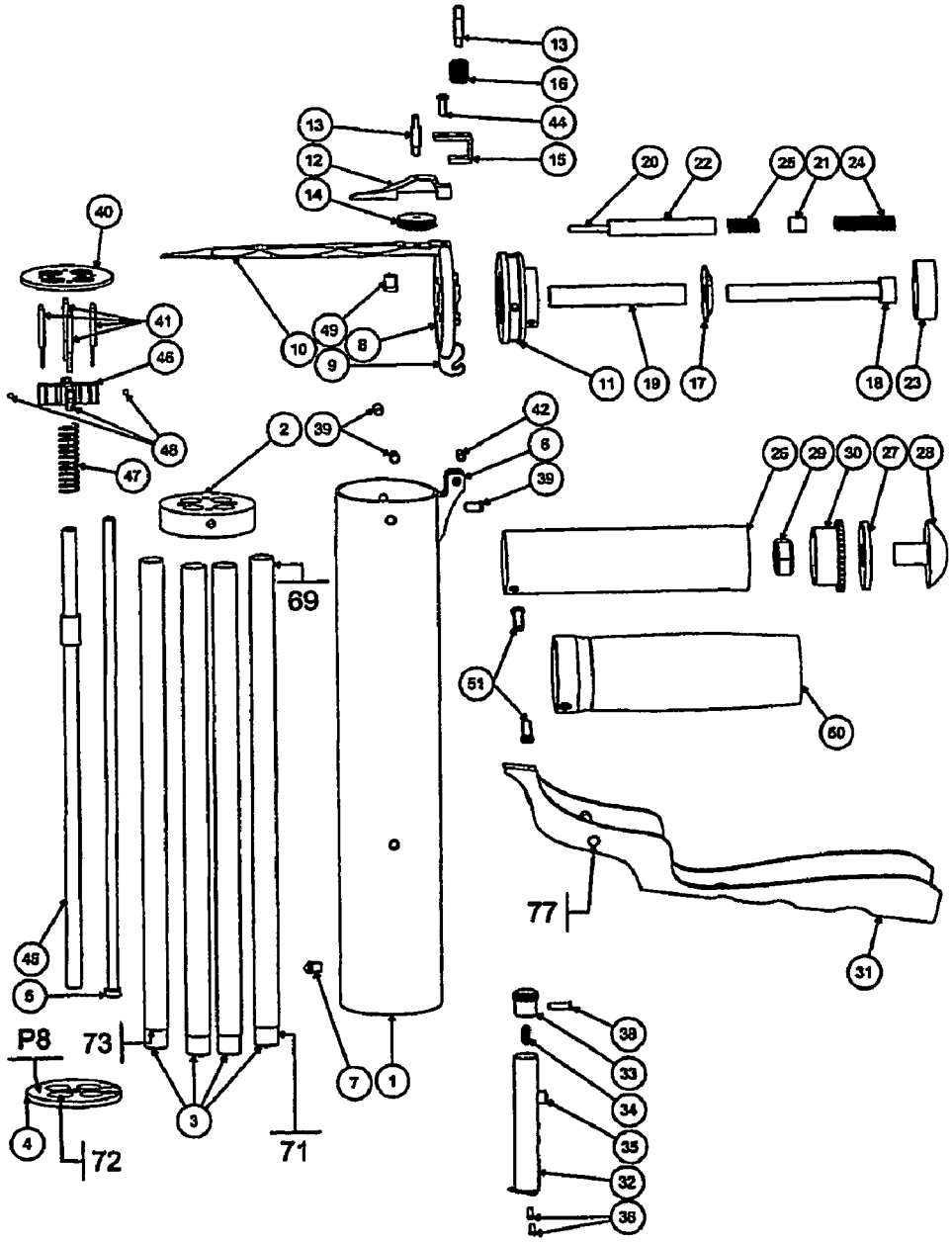
FIG. 4 shows an exploded perspective view of all the component parts of the childproof and accident-proof Rotating Percussion Handgun, which are duly numbered and individually arranged.

The firearm includes several barrels (3) (FIG. 4), four in the case of the embodiment presented, though this number may vary according to the alterations made. The barrels are assembled longitudinally and are arranged parallel to each other, their ends (69) being solidly threaded or fitted into an appropriate housing (70) (FIG. 7) inside the disc (2) which supports the barrels (FIG. 4). In turn, this disc is joined to the outer frame (1) by means of a thread, fitting together or screws (39), the barrels being fixed at their other end (71) by the barrel support disc (4) which attaches and supports the set (E) (FIG. 2*a*) of barrels.

The barrels, when they are inserted into the holes (72) in the disc (4), bump against this disc at the point where they project outwards (73). The disc (4) has a central hole through which freely passes with a minimum clearance the screw (5) that fixes to the plane (P8) (FIG. 8) the set of barrels (3), the outer frame (1) and the tube (45) that supports the ejection system to the plane (P9) (FIG. 7) of the supporting disc (2) in an appropriate threaded housing which does not extend beyond the limits of the plane (P10).

Figure 10:
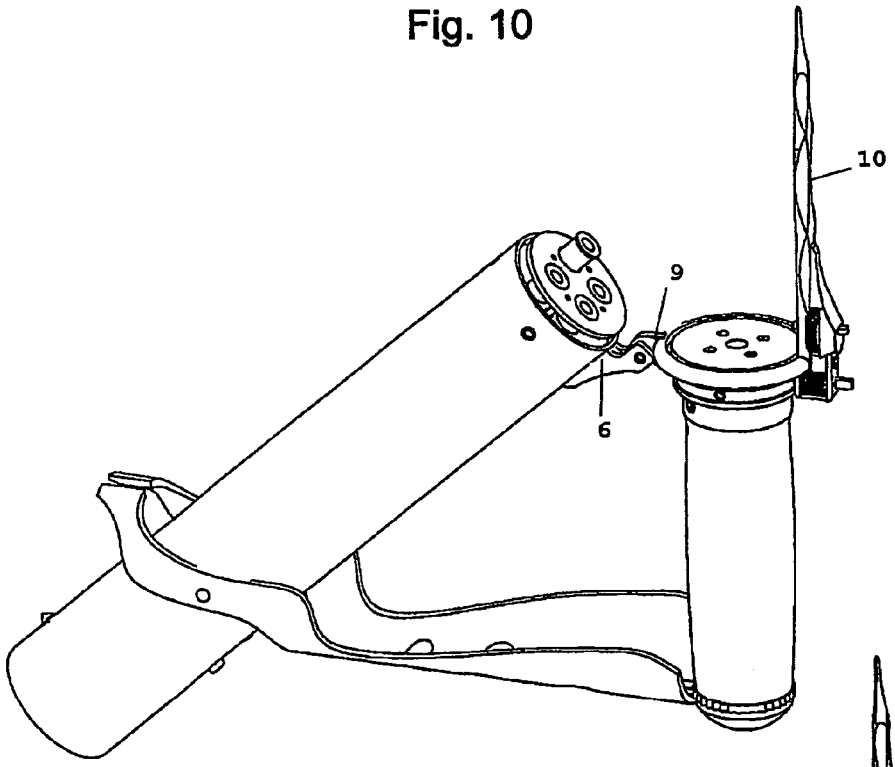
FIG. 10 shows a perspective view of the firearm when opened and in the loaded position, with the optional R.D.W.S. system.

The whole formed by the firing barrels (3) and by the outer frame (1) can be separated (FIG. 10) by means of its hinge (6-9) (FIGS. 4 and 10). This hinge has limited rotating movement within the whole, constituted by the rotating handle and the remaining elements, which can be removed by reducing the angle between them and the longitudinal axis of the handle. It has a recess (74) (FIGS. 6 and 10) in line with the transverse axis of the handle, causing the system to separate into two parts. One of these parts can be optionally fitted with an internal or external bayonet (10) (FIG. 6), coupled to the middle weapon on top of the ramps disc (8).

The ejection system (FIG. 7) comprises an ammunition holder disc (40) of a considerable thickness mounted on plane (P11) (FIG. 7*b*) by means of four longitudinal parallel threaded shafts (41), which are inserted at one end into the guiding holes (75) existing for this purpose in the ammunition holder disc (40) and at the other end of the part (2).

The shafts (41) are coupled and attached by the set of screws (48) to the part (46) which supports the movement of the ejection system. The part (46) is in turn mounted on a longitudinal elastic system consisting of a spring (47) (FIGS.

Figure 7:
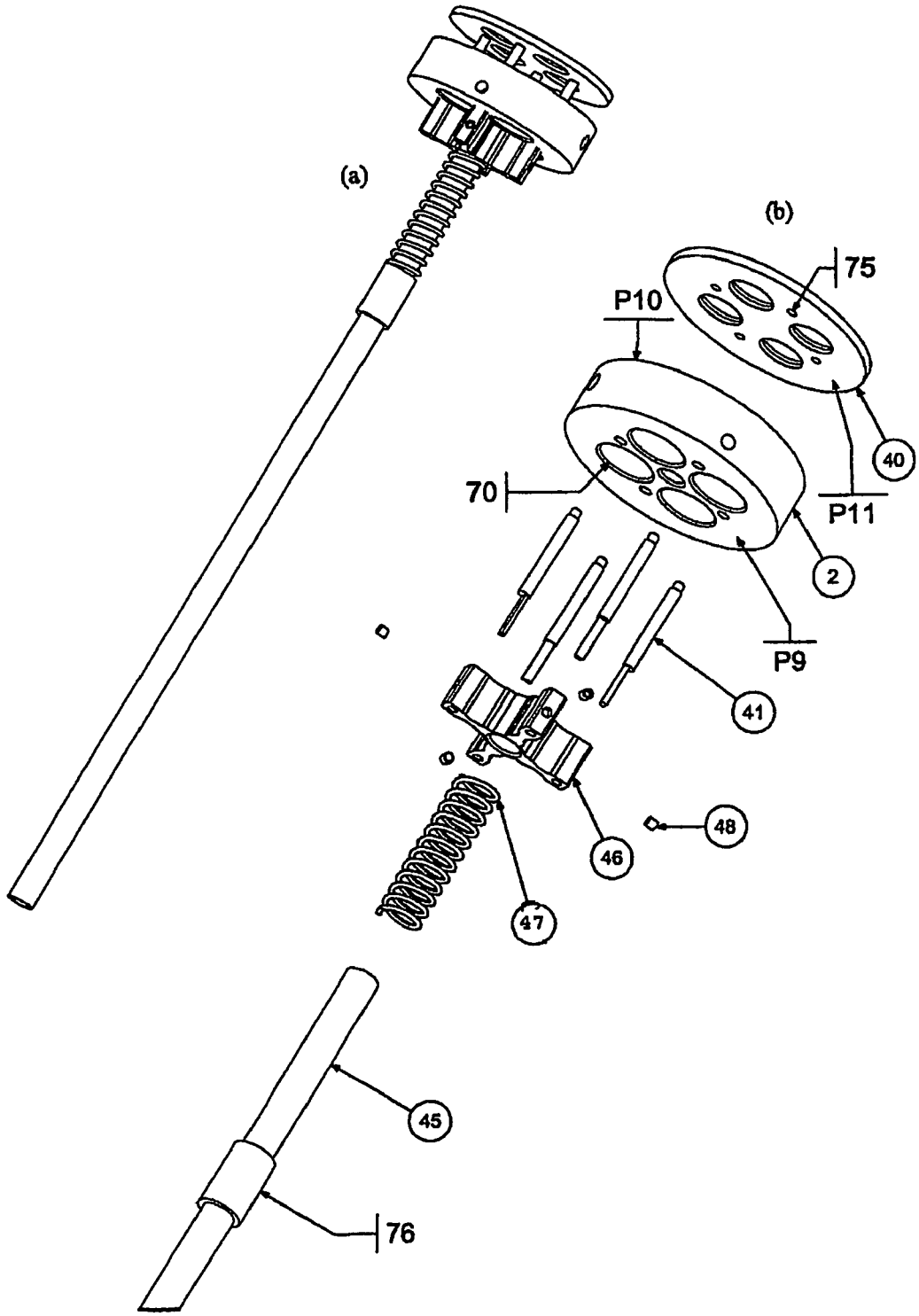
FIG. 7 shows isometric perspective views representing the semi-automatic cartridge ejection system, in both the assembled 7(*a*) and exploded 7(*b*) versions, all the parts being numbered, and arranged according to their layout.

4 and 7) supported at the appropriate point by the cylindrical projection (76) of the tube (45) (FIG. 7).

This whole set of parts, with the exception of the ammunition holder disc (40) is housed inside the outer frame (1).

The foldaway grip (G, 31) (FIGS. 2 and 4), which has an ergonomic design, is fitted around the outer frame (1) when it is in the closed position. This grip can rotate and its rotating movement occurs around the axis (77) defined by the two lateral supports (77) (FIG. 4), which are screwed or fitted into two laterally opposite holes on the outer frame (1).

Figure 11:
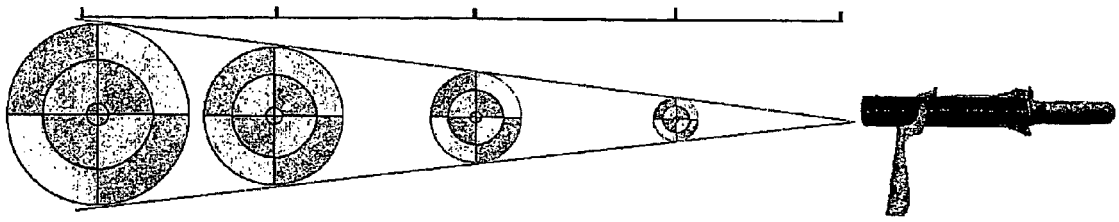
FIG. 11 show the demonstration of the integrated Progressive Impact Area Indicator laser sight.

The grip, when it is in the open position, has four functions: as a grip during the act of firing, as an auxiliary sight (F) (FIG. 2) for firing, as a vertical stabilising tripod and as a system for activating the laser. The laser system (FIG. 11) is activated by pressing the spring button (35) (FIG. 4), a service switch for the internal laser sight system which functions progressively according to distance, the grip (31) reaching at this point its maximum open position angle in relation to its own longitudinal axis. Under these conditions, the grip presses the switch button (35) (FIG. 4) which is situated at the bottom of the tube (1), at a precise point, thereby activating the laser system.

Figure 10A:
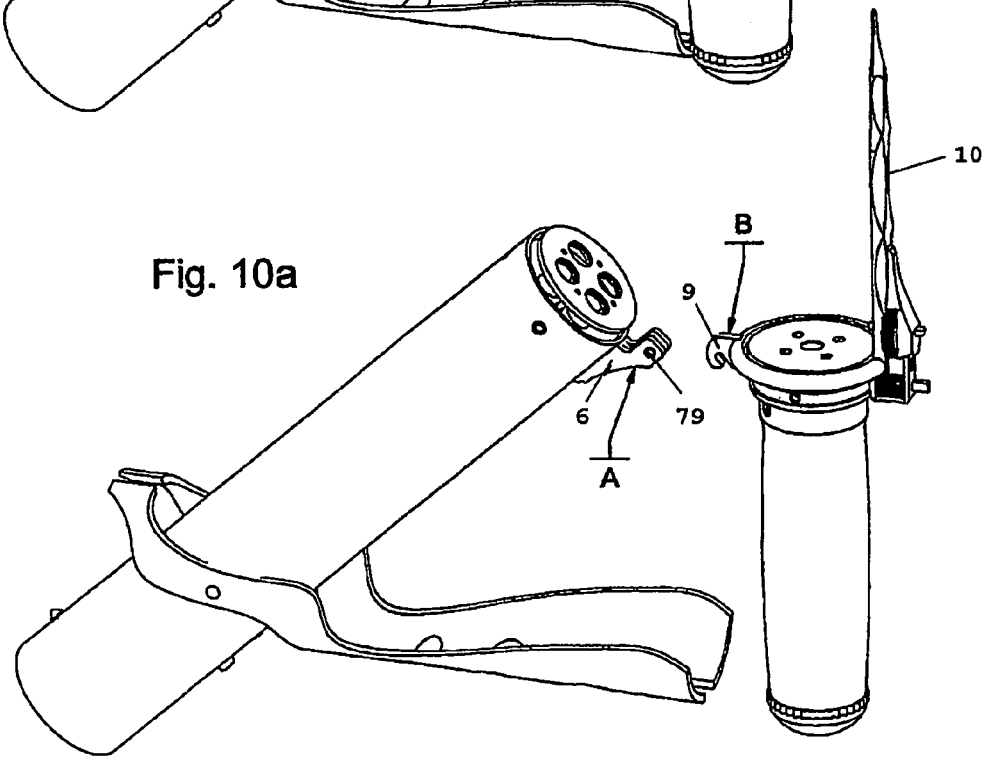
FIG. 10*a* shows a perspective view of the handle separated from the barrels with the firearm in the unloaded position, also depicting the bayonet element.

The set of barrels (3) can be separated from the handle (FIG. 10*a*) by reducing the angle of the set of barrels in relation to the longitudinal axis of the handle by means of the hinge system. The parts comprising this hinge system are firmly coupled by means of welding and/or screwing to the set of barrels and to the ramps disc (8), on side A and side B respectively (FIG. 10). One of the sides has a recess (74) (FIG. 6*a*) and the other has a transverse shaft (79) (FIG. 10*a*), which are released due to the rotating action and thus allow the whole structure to separate.

Figure 5:
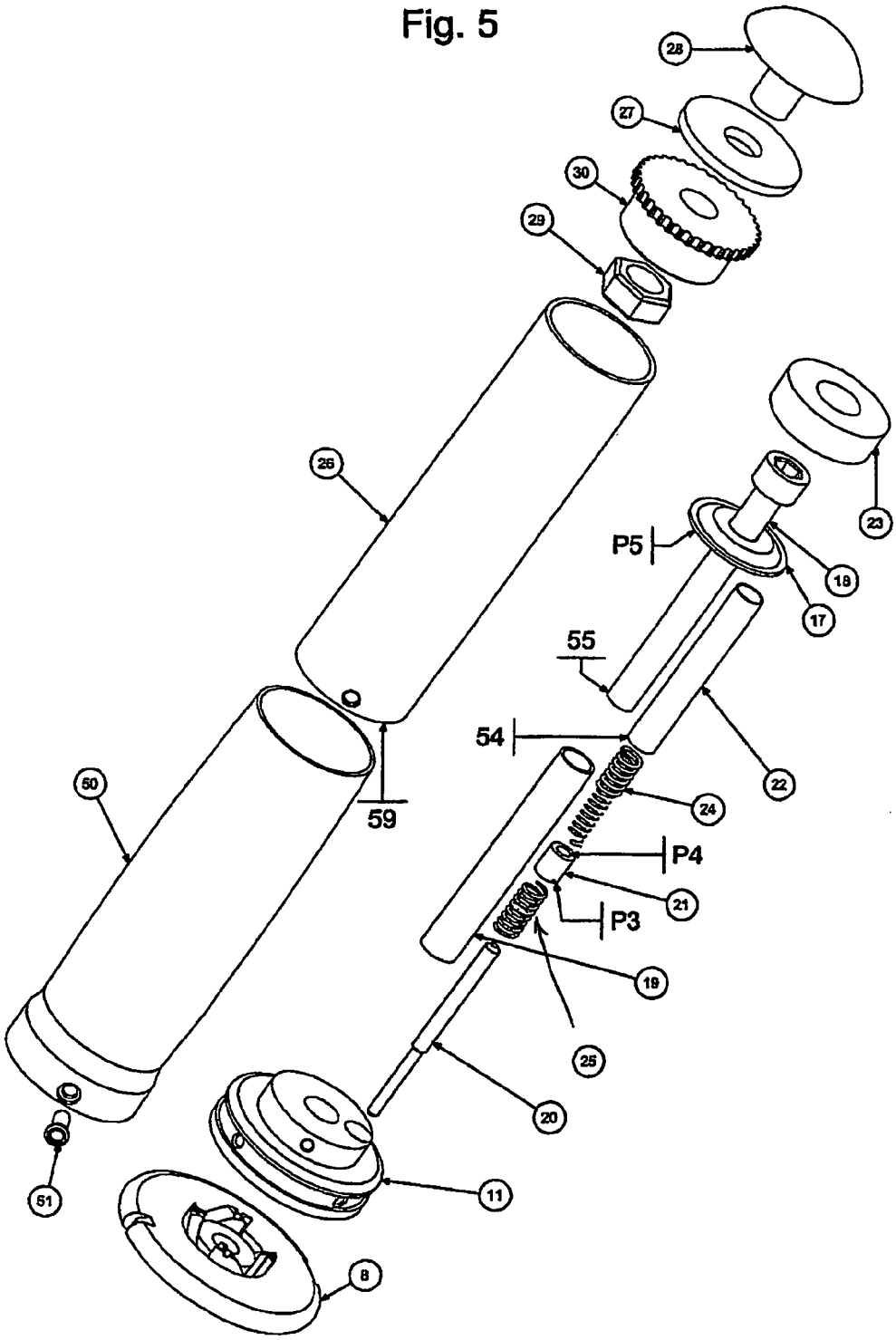
FIG. 5 shows an exploded isometric perspective view of the various parts which constitute the present percussion and firing mechanism.

Inside the handle, as well as the percussion mechanism, there is a container (80) (FIG. 3) for carrying extra ammunition which is closed by means of a cover (30) (FIG. 5).

Reference is also made to the existence of a sword-like hand protector attached to the handle, being either fixed or having rotational movement (not shown in the Figures), of a cord to be attached to the user's wrist coming from inside the handle through the central hole in the cover (30) and of a sight marker (7) (FIG. 4) in the form of a hexagonal screw with a conical tip, threaded to the top exit end of the outer frame (1).

It is considered that no further details need to be added to this description in order for any person skilled in the art to understand the present invention and the advantages that it offers. The materials, shapes and dimensions and the layout of the components can be altered, provided that this does not modify the essence of the present embodiment. The contents of this specification should always be considered in their broadest and not restricted terms.

The invention claimed is:

1. A rotary percussion handgun comprising; a handle to be grasped by one hand of a user; a tubular outer frame to be grasped by the user's other hand, the outer frame having a proximal end coupled to the handle by an intermediate member assembly, the outer frame enclosing a plurality of barrels and an ammunition ejection system;

the intermediate member assembly including a guide disc rotating relative to a load disc, the load disc being attached to the outer frame and the guide disc being attached to the handle, the load disc having an array of holes radially offset from a longitudinal axis of the handgun, the holes being coaxially aligned with the barrels, the guide disc having a guide aperture radially offset from the longitudinal axis, the guide aperture being coaxially alignable with each of the plurality of barrels;

the handle enclosing a firing mechanism, the firing mechanism extending coaxially from the guide aperture, the firing mechanism including a spring loaded firing member;

the handle, the guide and the firing mechanism rotate together along the longitudinal axis relative to the outer frame and the load disc, a full rotation of the handle includes a plurality of firing cycles corresponding to the number of barrels, each firing cycle starts with the firing member aligned to a first barrel, as the handle rotates, the load disc pushes the firing member away from the intermediate member, thereby compressing a compression spring, once the handle rotates to a position where the firing member is aligned with a second barrel, the load disc releases the firing member, the compression spring projects the firing member toward the intermediate member assembly, whereby the firing member contacts an ammunition cartridge and the handgun fires a hinge and a hinge lock;

the outer frame being pivotally connected to the handle by the hinge, the hinge having a hinge pin cooperating with a hinge recess to allow the outer frame to be selectively removable from the handgun; and the hinge lock including a hinge lock wheel cooperating with a bracket and a hinge lock pin to selectively lock the outer frame to the intermediate member assembly and the handle, the bracket being fixed to the intermediate member assembly and extending along the outer frame, the bracket having a hinge pin recess for receiving a first end of the hinge lock pin, the pin recess being contoured to prevent rotation of the hinge pin, the hinge wheel cooperating with the hinge pin, whereby as the hinge wheel rotates around the hinge pin, the pin translates axially, a frame journal is located in the outer frame for receiving a second end of the hinge pin, wherein by rotating the hinge wheel in a first direction, the hinge pin locks the outer frame to the intermediate member assembly, by rotating the hinge wheel in a second direction, the hinge pin exits the journal to unlock the outer frame from the intermediate member assembly, thereby allowing the outer frame to pivot about the hinge to an open position.

2. The handgun according to claim 1, whereby the firing member is a firing pin.

3. The handgun according to claim 1, further comprising a bayonet, the bayonet extending axially from the intermediate member assembly, along the outer frame, the bayonet being exposed when the outer frame is pivoted about the hinge to the open position.

4. The handgun according to claim 1, further comprising a front grip, the front grip being pivotally attached to the outer frame, the front grip pivoting to a first position where the front grip wraps around a portion of the frame, the front grip pivoting to a second position where the front grip is transverse to the frame, and the front grip having an aiming notch, the aiming notch being alignable with a sight marker on the distal end of the outer frame when the front grip is in the second position.

5. The handgun according to claim 4, further comprising a light source for projecting a beam of light on a target, the light source being attached to the outer frame, the light source being activated by contacting a switch, the switch being positioned on the outer frame such that the front grip contacts the switch when the front grip is in the second position.

6. The handgun according to claim 5, wherein the light source is a laser system, the laser system including a laser emitting device emitting light at the target.

7. The handgun according to claim 1, further comprising a handle locking safety system, the safety system selectively locks the handle to the outer frame, the safety system includes a safety wheel cooperating with a safety pin, the safety pin providing an axis for the safety wheel to rotate, the safety pin translates as the safety wheel rotates, the safety pin being rotationally constrained by a pin guide, the safety pin engages a an intermediate member assembly hole to lock the handle to the outer frame.

8. The handgun according to claim 1, further comprising;

an ammunition container located within the handle and providing an area for storing ammunition; and a recoil damper, the damper compressing when the handgun fires to reduce a recoil force transmitted to the user.

9. The handgun according to claim 1, wherein the plurality of barrels comprises at least four barrels.

10. The handgun according to claim 1, further comprising a torque adjustment mechanism to selectively adjust a torque required to rotate the handle relative to the outer frame.

11. A rotary percussion firearm comprising;

an outer frame coupled to a handle by an intermediate member;

the outer frame forming a tubular enclosure, containing a support structure, a plurality of barrels and an ammunition ejection system;

the support structure including a barrel support disc at the distal end of the outer frame, a support rod extends from the support disc along a longitudinal axis of the outer frame towards the intermediate member, an opposing end of the support rod is coupled to a transverse barrel housing, the support disc and the barrel housing having aligned apertures for receiving the plurality of barrels, the barrels being parallel to and offset radially from the support rod, the support rod having a spring stop attached, the spring stop providing a reaction point for an ejection spring of the ammunition ejection system, the ejection spring being aligned axially to the support rod providing axial support to an ejection assembly, the ejection assembly including an ejection support rigidly connected to an ammunition holder disc by a plurality of eject shafts, the ammunition disc having an array of ammo apertures for receiving a plurality of ammunition shells, the ejection support and the ammunition disc being positioned on opposite sides of the barrel housing with the eject shafts passing through the barrel housing, the ejection assembly translating distally to a load position while compressing the ejection spring;

the intermediate member including a ramp disc rotating relative to a coaxial guide disc, the ramp disc being attached to the outer frame and the guide disc being attached to the handle;

the ramp disc having an array of ramps, the ramps being aligned tangentially to and radially offset from the longitudinal axis, the ramps extending axially from a planer surface of the disc at an angle of inclination to a resting position followed by a rapid reduction in ramp height, an array of disc apertures being located axially adjacent to the ramps, the guide disc having a guide aperture radially offset from the longitudinal axis, wherein the guide aperture aligns axially with the ramps and disc apertures as the guide disc indexes about the ramp disc;

the handle being fixedly connected to the guide disc, the handle having a handle support and a firing mechanism;

the handle support having a screw extending from the ramp disc through the guide along the longitudinal axis, the screw having a support ring extending radially from a distal end of the screw;

the firing mechanism having a transporting tube axially adjacent to the screw, the tube extending from the guide aperture to the support ring, the tube enclosing a first firing spring, an adjustment block, a second firing spring and a striker, the striker being aligned coaxially with, and selectively translating within the tube, a first end of the striker cooperating with the ramp disc, the adjustment block being selectively adjusted to an intermediate portion of the striker, whereby the striker aligns the striker within the tube, a first spring extends from a first end of the adjustment block to the support ring, a second spring extends from a second end of the adjustment block to the guide, whereby the first and second springs store and exert energy as the striker translates; and the handle rotates relative to the outer frame, the firing mechanism rotates around the handle support, the striker translates within the tube as the first end of the striker cooperates with the ramps, when the striker moves past the resting position, the striker translates through the guide and ramp disc to contact ammunition in the outer frame.

* * * * *